US005692752A

United States Patent [19]

Hanna

[11] Patent Number: 5,692,752

[45] Date of Patent: Dec. 2, 1997

[54] METHOD FOR PLAYING A GAME

[76] Inventor: Deanna Hanna, 3510 N. Can-Ada Rd., Nampa, Id. 83687

[21] Appl. No.: 691,325

[22] Filed: Aug. 2, 1996

[51] Int. Cl.[6] ..... A63F 3/00

[52] U.S. Cl. ..... 273/248; 273/260

[58] Field of Search ..... 273/242, 243, 273/248, 249, 260, 261, 258

[56] References Cited

U.S. PATENT DOCUMENTS

| | | | |
|---|---|---|---|
| 571,464 | 11/1896 | Truex | 273/258 |
| 1,421,678 | 7/1922 | Ebert | 273/258 |
| 2,717,156 | 9/1955 | Nelson | 273/248 |
| 3,604,709 | 9/1971 | Svetz | 273/248 X |
| 4,278,255 | 7/1981 | Gillert | 273/248 |
| 4,715,608 | 12/1987 | Burt | 273/248 |
| 5,333,877 | 8/1994 | Pridgeon | 273/248 |
| 5,377,991 | 1/1995 | Olsen . | |

FOREIGN PATENT DOCUMENTS 210371 1/1924 United Kingdom .

*Primary Examiner*—William E. Stoll
*Attorney, Agent, or Firm*—Thorpe North & Western, L.L.P.

[57] ABSTRACT

A method for playing a game includes providing a game board with a checkerboard pattern disposed thereon, a first side defining a beginning position for a first player and an ending position for a second player, and a second side defining a beginning position for the second player and an ending position for the second player. A plurality of tokens are provided to each player for movement along the squares of the game board. In order to move his or her tokens from one square to a new position on another square of the checkerboard, the player must successfully answer a question. As the player attempts to move any given token to the ending position, he or she must be careful that the opposing party does not "jump" the token, thereby causing the token to be removed from the board. The process of selecting a desired new position and moving a token to the new position when the question posed is successfully answered continues until at least one token has reached a square at the ending position opposite the beginning position for that token, or until all of the tokens of one player have been removed from the game board.

19 Claims, 3 Drawing Sheets

METHOD FOR PLAYING A GAME

BACKGROUND OF THE INVENTION

1. Field of the Invention

The present invention relates to a method for playing a game and, more particularly, to a method of playing a game used for a playing a television game show wherein the contestants match strategy and knowledge in attempts to win prizes and money.

2. State of the Art

There are numerous board games wherein competing contestants attempt to outmaneuver the other contestant or contestants in order to accomplish the goals of the games. In recent years, however, the trend among game players has been away from these traditional games of strategy and toward games which are based on knowledge of trivia and related matters. These trivia games have been developed to cover a broad range of subjects. Typically such a trivia game is played by drawing a card which has one or more questions written thereon. If the correct answer is provided to the question, the player is allowed to roll dice and move his or her token along a defined movement path. Once the player has completed the defined movement path and answered the necessary number or type of questions, the game is completed. Generally, the first person to complete the game is declared the winner.

The movement paths used in trivia games are highly varied. For example, in U.S. Pat. No. 3,649,002, there is taught a game board having a variety of movement paths and playing positions. The movement of a player's token is selected by rolling a dice.

Another embodiment of a game board with movement paths is disclosed in U.S. Pat. No. D33,057. Still another game board teaches the use of game cards or dice to control movement options of a player around a perimeter movement track.

One perceived problem with many of the trivia games currently available is that there is little strategy involved with respect to the tokens of other players. While a player must progress his or her token as quickly as possible, there is no process by which the player can actively interfere with the progress of the token of a competing player or players. Thus, a significant element of strategy which was present in many traditional board games is lacking in the now popular trivia games.

Thus, there is desired a board game which combines the need for knowledge of trivia with the need for strategic acumen in order to prevail. Such a game should have relatively simple rules, while providing a long term challenge to even the most experienced player.

SUMMARY OF THE INVENTION

Thus, it is an object of the present invention to provide a new method for playing a game which combines the need for knowledge of trivia with strategic movement of one's playing tokens.

It is another object of the present invention to provide such a method for playing a game wherein a player can directly interfere with the advancement of the tokens of an opposing player.

It is another object of the present invention to provide such a method for playing a game which is easy to learn, but which provides a challenge even to experienced players.

It is still yet another object of the present invention to provide such a method for playing a game which may be easily adapted to public performance, such as pitting opposing contestants against one another in a televised game show.

The above and other objects of the invention are realized in specific illustrated embodiments of a method for playing a game including providing a game board with a checkerboard pattern disposed thereon, a first side defining a beginning position for a first player and an ending position for a second player, and a second side defining a beginning position for the second player and an ending position for the second player. A plurality of tokens are provided to each player for movement along the squares of the game board. In order to move his or her tokens from one square to a new position on another square of the checkerboard, the player must successfully answer a question. As the player attempts to move any given token to the ending position, he or she must be careful that the opposing party does not "jump" the token, thereby causing the token to be removed from the board. The process of selecting a desired new position and moving a token to the new position when the question posed is successfully answered continues until at least one token has reached a square at the ending position opposite the beginning position for that token, or until all of the tokens of one player have been removed from the game board.

In accordance with one aspect of the invention, the movement path of each token is limited to diagonal movement across the game board. Each square along the movement path has one or more questions assigned thereto. Typically, the assignment will be made by categorization of the questions by some common body of knowledge into which the questions relate.

In accordance with another aspect of the invention, the number of questions assigned to each square is limited. When all of the questions for that square have been asked, the tokens no longer may use that square as they are moved between the beginning and ending positions.

In accordance with another aspect of the invention, the method of playing a game includes providing questions with differing levels of difficulty and asking a more difficult question when movement of a players token to the new position involves jumping a token of the opposing player, thereby causing the opposing player's token to be removed from the board.

In accordance with yet another aspect of the present invention, the method of playing a game further includes designating at least one prize for each square, and awarding a specific prize to a player when his or her token moves onto a square associated with that prize. When a token reaches an ending position, the player is given a monetary reward.

In accordance with still another aspect of the method of the present invention, the winner of the game is determined by the number of each player's tokens which have reached the ending position for that player. In the event that each player has the same number of tokens which have reached the ending positions, the winner is determined by the number or value of the prizes received.

In accordance with still yet another aspect of the method of the present invention, a player winning the game is provided a bonus round wherein he or she attempts to move a token across the game board within a limited amount of time by successfully answering questions associated with each of the squares of the game board.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
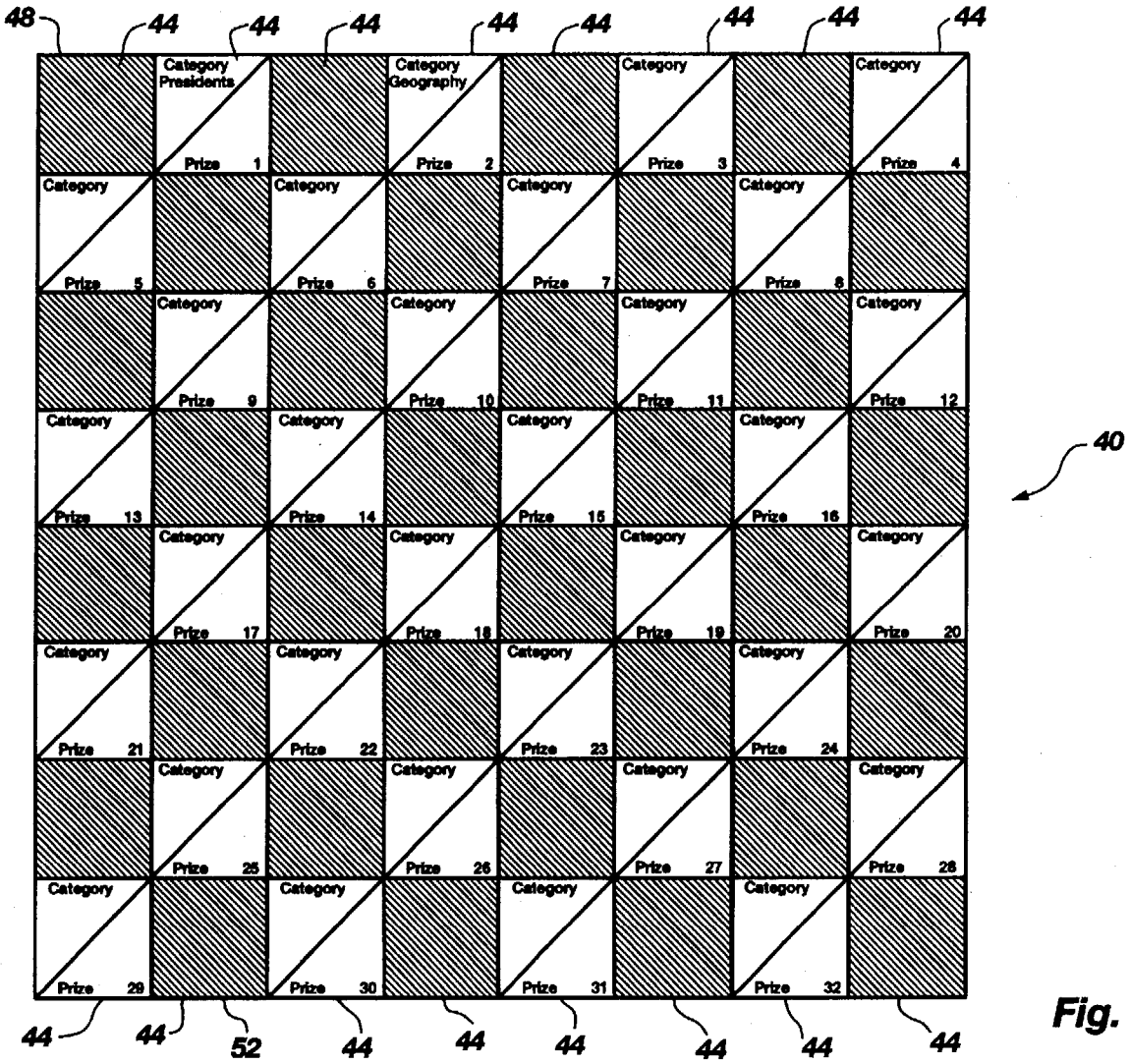
FIG. 1 shows a plan view of a game board for use in the present invention.

Referring to FIG. 1, there is shown a plan view of a game board for use with the method of the present invention. The game board, generally indicated at 40, includes a plurality of squares 44. Typically, a playing board with 64 squares is used, the squares being colored in an alternating pattern so as to create a checkerboard pattern. Thirty-two of the squares are numbered 1 through 32 to provide reference points for those playing the game. Each of the numbered squares includes an indication of a category from which questions associated with that square are drawn. For example, square 1, has questions associated therewith which relate to Presidents of the United States, while square 2 has questions associated therewith which relate to geography.

In addition to the category for the questions, the squares also indicate a prize which is received by players who successfully advance a token on to that square. The prize may be awarded each time a token moves onto the square, or may be provided only to the player controlling the first token to land thereon.

The remaining 32 squares, which are shaded in FIG. 1, are generally not used during play of the game. Thus, the tokens (FIG. 2) which are used in the game follow a diagonal movement pattern similar to the game of checkers.

The game board 40 has a first side 48 and a second side 52. Along the first side 48 are squares 1, 2, 3 and 4. Along the second side 52 are disposed squares 29, 30, 31, and 32. A first players tokens placed in squares adjacent the first side, i.e., a token is disposed on each of squares 1, 2, 3, and 4. Depending on the number of tokens desired, tokens can also be placed on squares 5 through 12 as well. These squares serve as the beginning position for the first player.

The tokens of the second player are disposed in squares adjacent the second side 52. Thus, the player will dispose tokens in squares 29 through 32, and may also use squares 21 through 28 depending on the number of tokens used.

The object of the game is for each player is to move as many tokens as possible form the beginning positions for each token into an ending position defined by the squares at the opposing side of the game board 40. Thus, for example, the first player will attempt to move as many squares as possible into squares 29 through 32, while the second player attempts to move as many tokens as possible into squares 1 through 4. Multiple tokens can complete the movement path by using the same square, although not simultaneously.

As a player moves his/her tokens from the beginning positions to the ending positions, the player must be aware of the movements of the other player, as one player's movements can cause the tokens of the other player to be removed from the board.

In order to move a token, the player must select a desired new position for that token which is generally one square forward, i.e. a diagonal movement to the right or left and toward the ending positions. The direction of movement for each token is limited to movement toward the ending positions for that token until a square of the ending positions is reached. The token may then move in any diagonal direction.

Once the desired new position is selected, a question is read to the player moving the token. The question is selected from a group of questions which typically is assigned to that square based on the category. If the player successfully answers the questions, the piece is moved to the new position and the player is awarded a prize assigned to the new position. If the question is not answered correctly, the player loses his or her turn. To make the game more challenging, the number of questions assigned to each square may be limited. Once all of the assigned questions are asked, the square may not be elected again.

The players alternatingly select new positions for each token until one of the players has won the game. This is determined by who has the highest number of tokens which have reached ending positions at the opposite side of the game board from which they started. If at any time a player has fewer tokens remaining than his or her opponent has tokens which have reached the ending positions, the game is terminated. Likewise, if all of the tokens of a player have been removed from the game board 40, the game is terminated and the player with tokens still on the game board is declared the winner.

Figure 2:
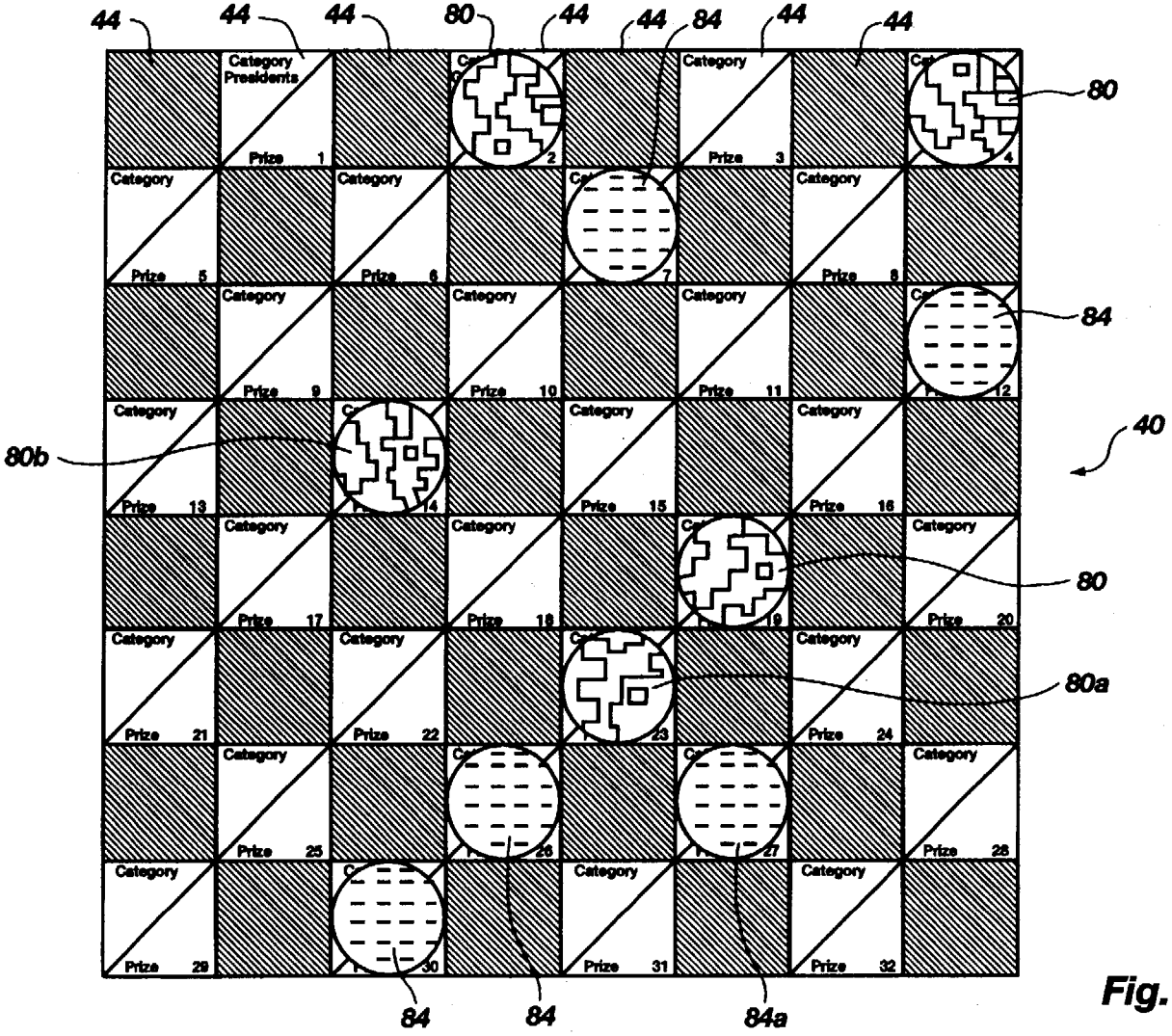
FIG. 2 shows the game board of FIG. 1 with a plurality of tokens disposed thereon.

Referring to FIG. 2, there is shown the game board 40 of FIG. 1 with a plurality of tokens disposed thereon. Of the ten tokens disposed on the board, five of the tokens, indicated at 80 belong to one player, while the other five tokens, indicated at 84 belong to the opposing player. The tokens are indicated as being gold and silver. The gold tokens will typically be used by the player who won the most recent game, or the returning champion when played in a "game show" format.

In order to remove a token of the opposing player from the game board 40, the player moving the token must "jump" the token to be removed. Thus, for example, if it is the turn of the first player to move, the first player being represented by the gold tokens, the player can cause token **84*a* to be removed from the board by selecting square 32 as the desired new position for token 80*a*** and successfully answer a question posed. Typically, the question asked when attempting a jump will be more difficult than a question posed when making a normal move from one square to another.

If the first player fails to answer the questions correctly, the second player, represented by the silver tokens is then given the opportunity to jump token **80*a* with token 84*a*. This is accomplished by selecting square 18 as the desired new position and correctly answering the question posed. If successfully completed, the second player may then select square 9 as the desired new position for token 84*a* and, if the question posed with respect to square 9 is successfully answered, token 80*b*** is also removed from the board. Thus, the second player would have completed a double jump and gained a significant advantage in the game.

In the alternative, the player could be allowed to select square 9 and then asked a significantly more difficult question. If answered correctly, the token 84*a* would be moved to square 9, and tokens 80*a* and 80*b* would be removed from the game board 40.

The questions which are asked when a jump is attempted can either be within the category assigned to the particular square, or there could be a first and second group of questions, the first group being easier questions assigned to respective squares and the second group being a separate pool of more difficult jump questions. Of course, the pool of jump questions could come from a common category if desired.

Figure 3:
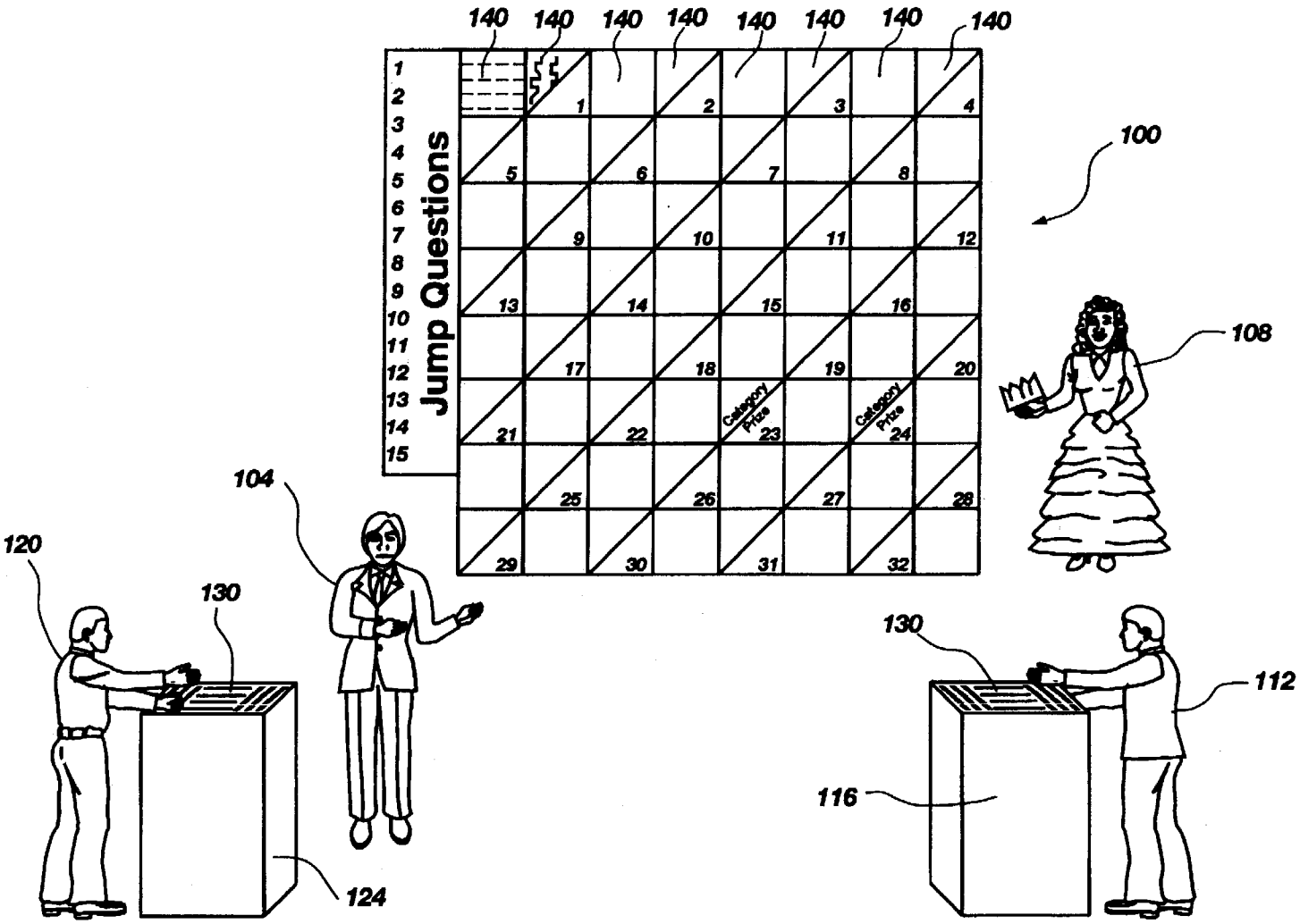
FIG. 3 shows a perspective view of a game show implementing the steps of the method for playing a game of the present invention.

Referring now to FIG. 3, there is shown a perspective view of a game show set, generally indicated at 100, implementing the method of the present invention. The game show uses a host 104 and hostess 108 and an enlarged game board 110. While the squares 140 of the game board will typically be silver and gold, any color may be used, and the colors are not indicated to simplify the accompanying drawings.

A first contestant 112 is positioned at a first podium 116, and a second contestant 120 is positioned at a second podium 124. Each player is provided with a small game board 130 and tokens to track the moves of the opposing player, as well as their own. Typically, the returning champion will be represented by the gold tokens and the challenger will be represented by the silver tokens.

To facilitate viewing by an audience, overhead cameras (not shown) may be used above the players, or the enlarged game board 110 could be a giant screen which shows the moves of each player.

To make a move, the player indicated the current position of a token and the desired new position, such as square 19. The host then asks a question from the category assigned to that square. If successfully answered, the player's token is moved to the new square and a prize associated with the square is awarded. Typically, each square 140 will have three questions assigned thereto, and will have a prize for each question. Mixed in with the questions are 2 "loose a turn" messages, 2 "free move" messages, and 1 "extra chance" message. The messages are used as follows. When a player selects a square, the host selects a card with a question from the designated category. Occasionally, instead of a question being printed on the card, one of the preceding statements is contained thereon, forfeiting the players turn, allowing a free move at a subsequent time, or allowing two opportunities to correctly answer a question contained on the card. In the alternative to cards, the question or indicator could appear on the game board 110, thereby allowing the audience to see the question or message.

As shown in FIG. 3, the jump questions are separate from the categories on the squares 140 of the game board 110. When desiring to jump another player's token, the player selects from one of 15 jump questions. If successfully answered, he is allowed to jump the piece and receives the indicated prize.

When a player's token reaches the ending positions at the opposite side of the game board 110, the player is awarded a monetary prize, such as $1000, and given credit for one king. At the end of regulation play, the player with the most kings is declared the winner and requests to be kinged.

As a bonus round, the winner is given one token and is allowed to choose any square along one side of the game board. The player is then given a defined period of time, as measured by a timing instrument, such as a clock, in which to move the token across the game board 110 by correctly answering the questions posed. Each square 140 may only be chosen once, but the player can move in any diagonal direction to circumnavigate around blocked squares so long as there is sufficient time. If the player is able to advance his or her token across the game board within the defined time period, the player receives a substantially larger award, such as $25,000. The winner is invited back for the next contest. Any player winning a predetermined number of games is invited back for annual or semiannual tournament play.

In the process of using the method of playing a game of the present invention, the player must have both a considerable knowledge of trivia or other information, and have strategic skills to avoid being eliminated by the other player. If a person's knowledge of trivia, et cetera, is insufficient, he or she will be unable to adequately move his or her pieces across the board. If the person is lacking in strategy, a person having a less grasp of trivia may eliminate a sufficient number of tokens from the more knowledgeable opponent to win the game.

Thus there is disclosed a method for playing a game which combines the interesting aspects of both trivia and strategy games. Those skilled in the art will appreciate that numerous modifications can be made without departing from the scope and spirit of the present invention. The appended claims are intended to cover such modifications.

What is claimed is:

1. A method for two players to play a game with a game board having (i) a checkerboard pattern with opposing first and second sides and a plurality of squares disposed therebetween, each of the first and second sides defining at least one beginning position for one player and at least one ending position for the other player, and (ii) a plurality of tokens for movement along the squares of the game board, the method comprising:

a) placing the tokens for each player on the at least one beginning position of the game board for that player;

b) permitting a player to select a desired new position along the squares of the checkerboard pattern for one of the player's tokens;

c) asking a question to the player which, if successfully answered, entitles the player to advance said token to the desired new position;

d) giving a player a prize each time one of the player's token is advanced to a desired position; and e) repeating steps (b) and (c) for each player until at least one token has reached a square at the ending position opposite the beginning position for said token.

2. The method of claim 1, and wherein step (b) comprises, more specifically, selecting a desired new position diagonally disposed relative to the position on which the token is disposed prior to performing step (b).

3. The method of claim 1, wherein the method further comprises permitting movement of the tokens only in directions from the respective at least one starting position generally toward the respective ending positions until a token reaches the ending position, and permitting a token which has reached one of the at least one ending position to move in any direction thereafter.

4. A method for two players to play a game with a game board having (i) a checkerboard pattern with opposing first and second sides and a plurality of squares disposed therebetween, each of the first and second sides defining at least one beginning position for one player and at least one ending position for the other player, and (ii) a plurality of tokens for movement along the squares of the game board, the method comprising:

a) assigning at least one question to each square of the checkerboard along which the tokens move;

b) placing the tokens for each player on the at least one beginning position of the game board for that player;

c) permitting a player to select a desired new position along the squares of the checkerboard pattern for one of the player's tokens;

d) asking a question to the player which, if successfully answered, entitles the player to advance said token to the desired new position; and e) repeating steps (c) and (d) for each player until at least one token has reached a square at the ending position opposite the beginning position for said token.

5. The method of claim 4, wherein the method further comprises, assigning a defined number of questions to each square, and limiting the number of times a square may be selected as the desired position to the number of questions assigned thereto.

6. A method for two players to play a game with a game board having (i) a checkerboard pattern with opposing first and second sides and a plurality of squares disposed therebetween, each of the first and second sides defining at least one beginning position for one player and at least one ending position for the other player, and (ii) a plurality of tokens for movement along the squares of the game board, the method comprising:

a) placing the tokens for each player on the at least one beginning position of the game board for that player;

b) permitting a player to select a desired new position along the squares of the checkerboard pattern for one of the player's tokens;

c) asking a question to the player which, if successfully answered, entitles the player to advance said token to the desired new position, the question to be posed to the player being selected based on the desired new position selected by the player; and d) repeating steps (b) and (c) for each player until at least one token has reached a square at the ending position opposite the beginning position for said token.

7. A method for two players to play a game with a game board having (i) a checkerboard pattern with opposing first and second sides and a plurality of squares disposed therebetween, each of the first and second sides defining at least one beginning position for one player and at least one ending position for the other player, and (ii) a plurality of tokens for movement along the squares of the game board, the method comprising:

a) placing the tokens for each player on the at least one beginning position of the game board for that player;

b) permitting a player to select a desired new position along the squares of the checkerboard pattern for one of the player's tokens;

c) asking a question to the player which, if successfully answered, entitles the player to advance said token to the desired new position;

d) removing a target token from the playing board when the token of another player passes over said target token; and e) repeating steps (b) and (c) for each player until at least one token has reached a square at the ending position opposite the beginning position for said token.

8. The method of claim 7, wherein step (c) of the method comprises the additional steps of (i) assigning a plurality of questions of differing difficulty to the squares, and (ii) asking a more difficult question from the plurality of questions if movement of the player's token to the desired position will cause the token to pass over a token of the other player.

9. The method of claim 7, wherein the method further comprises alternatingly repeating steps (b) and (c) between the two players until all tokens of one player which have not been removed from the game board have arrived at the ending position.

10. The method of claim 9, wherein the method further comprises declaring the player with the most tokens having arrived at the ending positions as the winner.

11. The method of claim 7, wherein step (c) of the method comprises the additional steps of:

(i) assigning to the squares a first plurality of questions to be asked of players desiring to move a token onto that square, and (ii) providing a second plurality of questions, the second plurality being generally more difficult than the first plurality, and asking a question from the second plurality of questions if movement of the player's token to the desired position will cause the token to pass over a token of the other player.

12. The method of claim 7, wherein the method further comprises repeating steps (b) and (c) until one player has more tokens having reached the ending positions than the other player has on the playing board.

13. The method of claim 7, wherein the method further comprises repeating steps (b) and (c) until all tokens of one player have been removed from the game board.

14. A method for two players to play a game with a game board having (i) a checkerboard pattern with opposing first and second sides and a plurality of uniform geometric shapes disposed therebetween, each of the first and second sides defining a beginning position for one player and ending position for the other player, and (ii) a plurality of tokens for movement along the shapes of the game board, the method comprising:

a) placing the tokens for each player on a beginning position of the game board for that player;

b) permitting a player to select a desired new position along the shapes of the checkerboard pattern for one of the player's tokens;

c) asking a question associated with the desired new position to the player which, if successfully answered, entitles the player to advance said token to the desired new position;

d) repeating steps (b) and (c) for each player until at least one token has reached a square at the ending position opposite the beginning position for said token.

15. The method according to claim 14, wherein the method comprises, more specifically, assigning a plurality of questions selected from common subject matter to each shape and indicating the subject matter on the shape.

16. The method according to claim 14, wherein step (c) comprises, more specifically, providing a prize to a player each time one or his or her tokens advances to a new position.

17. The method according to claim 14, wherein the method further comprises determining a winner by selecting the player with the most number of tokens having reached the ending position.

18. The method according to claim 17, wherein the method further comprises providing a bonus round to the winner, the bonus round comprising the additional steps of:

a) placing a tokens on a beginning position at one side of the game board;

b) beginning a timing instrument set to expire after a predetermined period of time c) permitting the winner to select a desired new position along the shape of the checkerboard pattern for the token;

d) asking a question associated with the desired new position to the player which, if successfully answered, entitles the player to advance said token to the desired new position;

e) repeating steps (c) and (d) until the timing instrument has expired or the token has reached an ending position opposite the beginning position.

19. The method according to claim 18, wherein the method further comprises awarding the winner a cash award if the token reaches the ending position before expiration of the timing instrument.

* * * * *